US009751189B2

(12) United States Patent
Chen et al.

(10) Patent No.: US 9,751,189 B2
(45) Date of Patent: Sep. 5, 2017

(54) COMPLIANT POLISHING PAD AND POLISHING MODULE

(71) Applicant: Applied Materials, Inc., Santa Clara, CA (US)

(72) Inventors: Chih Hung Chen, Sunnyvale, CA (US); Jay Gurusamy, Santa Clara, CA (US); Steven M. Zuniga, Soquel, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 0 days.

(21) Appl. No.: 14/476,991

(22) Filed: Sep. 4, 2014

(65) Prior Publication Data

US 2016/0005618 A1 Jan. 7, 2016

Related U.S. Application Data

(60) Provisional application No. 62/020,857, filed on Jul. 3, 2014.

(51) Int. Cl.
*B24B 41/047* (2006.01)
*B24B 37/10* (2012.01)

(52) U.S. Cl.
CPC ..... *B24B 41/047* (2013.01); *B24B 37/10* (2013.01)

(58) Field of Classification Search
CPC ..... B24B 7/22; B24B 41/047; B24B 37/10
USPC ..... 451/41, 504, 505
See application file for complete search history.

(56) References Cited

U.S. PATENT DOCUMENTS 5,255,474 A * 10/1993 Gawa ..... B24B 13/012 451/285
5,840,202 A 11/1998 Walsh
5,931,719 A * 8/1999 Nagahara ..... B24B 37/12 451/287
5,934,979 A 8/1999 Talieh
5,938,504 A 8/1999 Talieh
5,944,582 A 8/1999 Talieh
6,113,466 A 9/2000 Lin
6,159,080 A 12/2000 Talieh
6,165,057 A * 12/2000 Gill, Jr. ..... B24B 37/005 451/287
6,179,690 B1 1/2001 Talieh
6,398,625 B1 6/2002 Talieh
(Continued)

FOREIGN PATENT DOCUMENTS

JP 2011-224697 A 11/2011
KR 2007-0117304 A 12/2007

OTHER PUBLICATIONS

U.S. Appl. No. 14/334,608 in the name of Hung Chih Chen, et al.; entitled Orbital Polishing With Small Pad; 31 total pages; filed Jul. 17, 2014.

(Continued)

*Primary Examiner* — Robert Rose
(74) *Attorney, Agent, or Firm* — Patterson + Sheridan LLP

(57) ABSTRACT

A polishing device includes a housing, a flexible base coupled to the housing, and a contact region disposed on a first side of the flexible base, wherein the flexible base expands and contracts based on pressure contained within the housing and a second side of the flexible base to form a contact area on the first side that is less than a surface area of the flexible base.

19 Claims, 3 Drawing Sheets

(56) References Cited

U.S. PATENT DOCUMENTS

| | | | | |
|---|---|---|---|---|
| 6,439,979 | B1 * | 8/2002 | Beppu | B24B 37/12 451/285 |
| 6,602,121 | B1 | 8/2003 | Halley | |
| 6,951,507 | B2 | 10/2005 | Talieh | |
| 7,121,933 | B2 * | 10/2006 | Kim | B24D 7/14 451/285 |
| 7,198,551 | B2 | 4/2007 | Talieh | |
| 7,312,154 | B2 * | 12/2007 | Cites | B24B 37/013 216/84 |
| 7,520,939 | B2 | 4/2009 | Ho et al. | |
| 7,993,485 | B2 | 8/2011 | Wasinger et al. | |
| 8,133,096 | B2 | 3/2012 | Emami et al. | |
| 8,142,260 | B2 | 3/2012 | Kollata et al. | |
| 2002/0039879 | A1 | 4/2002 | Zuniga et al. | |
| 2002/0132566 | A1 | 9/2002 | Jeong | |
| 2004/0266193 | A1 | 12/2004 | Bogart et al. | |
| 2005/0014456 | A1 | 1/2005 | Hoshino | |
| 2006/0094341 | A1 * | 5/2006 | Schneider | B24B 13/012 451/41 |
| 2007/0272356 | A1 | 11/2007 | Chen et al. | |
| 2010/0035526 | A1 | 2/2010 | Tolles et al. | |
| 2012/0171933 | A1 | 7/2012 | Chen | |

OTHER PUBLICATIONS

U.S. Appl. No. 62/026,269; entitled Polishing System With Pad Carrier and Conditioning Station; 28 total pages; filed Jul. 18, 2014.

U.S. Appl. No. 14/334,948 in the name of Jayakumar Gurusamy, et al.; entitled Modifying Substrate Thickness Profiles; 29 total pages; filed Jul. 18, 2014.

U.S. Appl. No 14/464,633 in the name of Hung Chih Chen; entitled Polishing Pad Configuration and Chemical Mechanical Polishing System; 36 total pages; filed Aug. 20, 2014.

PCT Notification of Transmittal of the International Search Report and the Written Opinion of the International Searching Authority for International Application No. PCT/US2014/058452 dated Jan. 8, 2015; 11 total pages.

International Search Report and Written Opinion for Application No. PCT/US2015/030592 dated Aug. 26, 2015; 17 total pages.

* cited by examiner

COMPLIANT POLISHING PAD AND POLISHING MODULE

CROSS-REFERENCE TO RELATED APPLICATIONS

This application claims benefit of U.S. Provisional Patent Application Ser. No. 62/020,857, filed Jul. 3, 2014, which is hereby incorporated by reference herein.

BACKGROUND

Field

Embodiments of the present disclosure generally relate to methods and apparatus for polishing a substrate, such as a semiconductor substrate. More particularly, to methods and apparatus for polishing an edge of a substrate in an electronic device fabrication process.

Description of the Related Art

Chemical mechanical polishing is one process commonly used in the manufacture of high-density integrated circuits to planarize or polish a layer of material deposited on a substrate by moving a feature side, i.e., a deposit receiving surface, of the substrate in contact with a polishing pad while in the presence of a polishing fluid. In a typical polishing process, the substrate is retained in a carrier head that urges or presses the backside of the substrate toward a polishing pad. Material is removed from the feature side of the substrate that is in contact with the polishing pad through a combination of chemical and mechanical activity.

The carrier head may contain multiple individually controlled pressure regions that apply differential pressure to different regions of the substrate. For example, if greater material removal is desired at peripheral edges of the substrate as compared to the material removal desired at the center of the substrate, the carrier head may be used to apply more pressure to the peripheral edges of the substrate. However, the stiffness of the substrate tends to redistribute the pressure applied to the substrate by the carrier head such that the pressure applied to the substrate may be spread or smoothed. The smoothing effect makes local pressure application, for local material removal, difficult if not impossible. Further, substrates may become non-planar during processing and, when polished in conventional systems, certain regions on the substrate may experience an over-removal or under-removal of material, which may be due to substrate quality, precision of polishing control, or other factors, each of which may damage portions of devices on the substrate thereby reducing yield.

Therefore, there is a need for a method and apparatus that facilitates removal of materials from local areas of a substrate.

SUMMARY

Embodiments of the present disclosure generally relate to methods and apparatus for polishing a substrate, such as a semiconductor substrate. In one embodiment, a polishing device is provided. The polishing device includes a housing, a flexible base coupled to the housing, and a contact region disposed on a first side of the flexible base, wherein the flexible base expands and contracts based on pressure contained within the housing and a second side of the flexible base to form a contact area on the first side that is less than a surface area of the flexible base.

In another embodiment, a polishing module is provided. The polishing module includes a chuck having a substrate receiving surface and a perimeter, and a polishing pad positioned about the perimeter of the chuck, the polishing pad comprising a contact region positioned about a center of a flexible base, wherein the polishing pad is inflatable by pressure application to a backside of the flexible base.

In another embodiment, a method of polishing a substrate is provided. The method includes urging a polishing pad disposed on a housing against a surface of a substrate, the polishing pad being disposed on a flexible base, and adjusting a contact area of the polishing pad by adjusting a pressure to a backside of the flexible base, wherein the contact area is less than a surface area of the flexible base.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments of the disclosure provide a polishing system and a polishing module utilized to polish a substrate in conjunction with a polishing system. Embodiments of the polishing module as described herein provide fine resolution (e.g., less than about 3 millimeters (mm)) in the radial direction and theta (Θ) direction rate control. Aspects of the disclosure include improved local polishing control with limited dishing and/or erosion in the local areas.

Figure 1A:
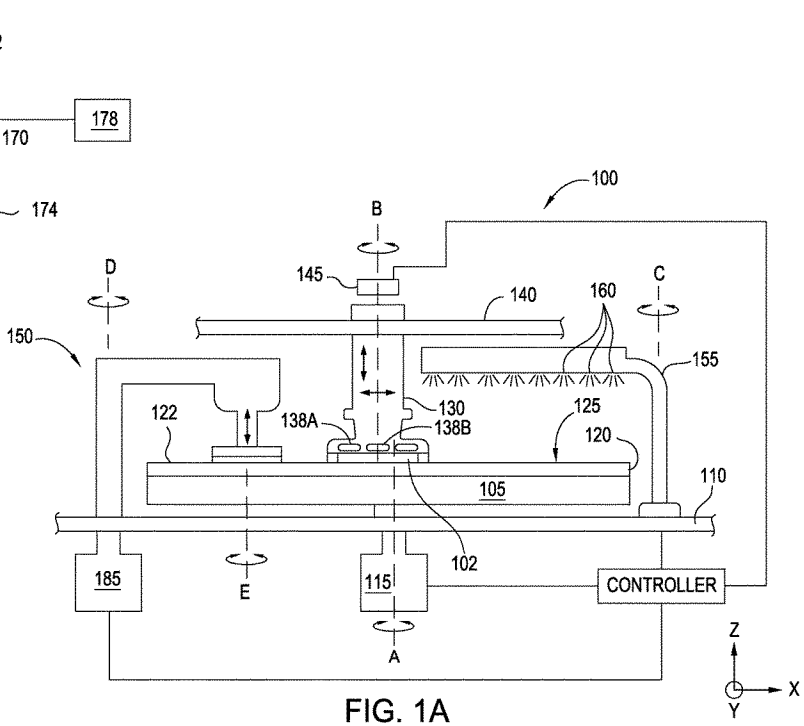
FIG. 1A is a partial sectional view of one embodiment of a processing station.
Figure 1B:
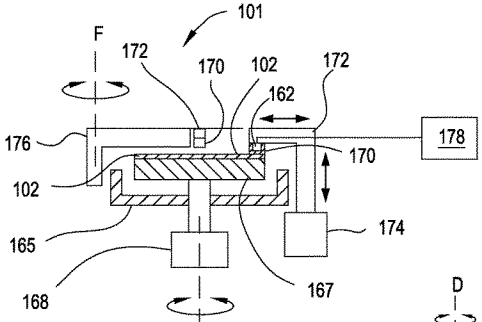
FIG. 1B is a schematic sectional view of one embodiment of a polishing module.

FIG. 1A is a partial sectional view of one embodiment of a processing station 100 that is configured to perform a polishing process, such as a chemical mechanical polishing (CMP) process or an electrochemical mechanical polishing (ECMP) process. FIG. 1B is a schematic sectional view of one embodiment of a polishing module 101 that, when used in conjunction with the processing station 100, comprises one embodiment of a polishing system. The processing station 100 may be used to perform a global CMP process, for example to polish the entire surface of a major side of a substrate 102. In the event that local areas of the substrate 102, such as a peripheral edge of the substrate 102, are not polished sufficiently using the processing station 100, the polishing module 101 may be used to polish the local area. The polishing module 101 may be used to polish an edge, or other local area of the substrate 102, before or after a global CMP process performed by the processing station 100. Each of the processing station 100 and the polishing module 101 may be a stand-alone unit or part of a larger processing system. Examples of a larger processing system that may be adapted to utilize one or both of the processing station 100 and the polishing module 101 include REFLEXION®, REFLEXION® LK, MIRRA MESA® polishing systems available from Applied Materials, Inc., located in Santa Clara, Calif., among other polishing systems, as well as polishing systems available from other manufacturers.

The processing station 100 includes a platen 105 rotatably supported on a base 110. The platen 105 is operably coupled to a drive motor 115 adapted to rotate the platen 105 about a rotational axis A. The platen 105 supports a polishing pad 120 made of a polishing material 122. In one embodiment, the polishing material 122 of the polishing pad 120 is a commercially available pad material, such as polymer based pad materials typically utilized in CMP processes. The polymer material may be a polyurethane, a polycarbonate, fluoropolymers, polytetrafluoroethylene (PTFE), polyphenylene sulfide (PPS), or combinations thereof. The polishing material 122 may further comprise open or closed cell foamed polymers, elastomers, felt, impregnated felt, plastics, and like materials compatible with the processing chemistries. In another embodiment, the polishing material 122 is a felt material impregnated with a porous coating. In other embodiments, the polishing material 122 includes a material that is at least partially conductive.

A carrier head 130 is disposed above a processing surface 125 of the polishing pad 120. The carrier head 130 retains the substrate 102 and controllably urges the substrate 102 towards the processing surface 125 (along the Z axis) of the polishing pad 120 during processing. The carrier head 130 contains a zoned pressure control device shown as an outer zone pressure applicator 138A and an inner zone pressure applicator 138B (both shown in phantom). The outer zone pressure applicator 138A and the inner zone pressure applicator 138B apply a variable pressure to the backside of the substrate 102 during polishing. The outer zone pressure applicator 138A and the inner zone pressure applicator 138B may be adjusted to provide more pressure against the edge region of the substrate 102 as compared to the center area of the substrate 102, and vise versa. Thus, the outer zone pressure applicator 138A and the inner zone pressure applicator 138B are used to tune the polishing process.

The carrier head 130 is mounted to a support member 140 that supports the carrier head 130 and facilitates movement of the carrier head 130 relative to the polishing pad 120. The support member 140 may be coupled to the base 110 or mounted above the processing station 100 in a manner that suspends the carrier head 130 above the polishing pad 120. In one embodiment, the support member 140 is a carousel, a linear track or a circular track that is mounted above the processing station 100. The carrier head 130 is coupled to a drive system 145 that provides at least rotational movement of the carrier head 130 about a rotational axis B. The drive system 145 may additionally be configured to move the carrier head 130 along the support member 140 laterally (X and/or Y axes) relative to the polishing pad 120. In one embodiment, the drive system 145 moves the carrier head 130 vertically (Z axis) relative to the polishing pad 120 in addition to lateral movement. For example, the drive system 145 may be utilized to move the substrate 102 towards the polishing pad 120 in addition to providing rotational and/or lateral movement of the substrate 102 relative to the polishing pad 120. The lateral movement of the carrier head 130 may be a linear or an arcing or sweeping motion.

A conditioning device 150 and a fluid applicator 155 are shown positioned over the processing surface 125 of the polishing pad 120. The conditioning device 150 is coupled to the base 110 and includes an actuator 185 that may be adapted to rotate the conditioning device 150 or move the conditioning device 150 in one or more linear directions relative to the polishing pad 120 and/or the base 110. The fluid applicator 155 includes one or more nozzles 160 adapted to deliver polishing fluids to a portion of the polishing pad 120. The fluid applicator 155 is rotatably coupled to the base 110. In one embodiment, the fluid applicator 155 is adapted to rotate about a rotational axis C and provides a polishing fluid that is directed toward the processing surface 125. The polishing fluid may be a chemical solution, water, a polishing compound, a cleaning solution, or a combination thereof.

FIG. 1B is a schematic sectional view of one embodiment of the polishing module 101. The polishing module 101 includes a base 165 supporting a chuck 167, which rotatably supports the substrate 102 thereon. The chuck 167 may be a vacuum chuck in one embodiment. The chuck 167 is coupled to a drive device 168, which may be a motor or actuator, providing at least rotational movement of the chuck 167 about axis E.

The substrate 102 is disposed on the chuck 167 in a "face-up" orientation such that the feature side of the substrate 102 faces a polishing pad 170. The polishing pad 170 is utilized to polish the peripheral edge of the substrate 102 or other areas of the substrate 102. The polishing of the substrate 102 on the polishing module 101 may be performed before or after polishing of the substrate 102 in the processing station 100 of FIG. 1A. The polishing pad 170 may comprise a commercially available pad material, such as polymer based pad materials typically utilized in CMP processes, or other suitable polishing pad or polishing material. The polishing pad 170 is coupled to a support arm 172 that moves the pad relative to the substrate 102. The support arm 172 may be coupled to an actuator 174 that moves the support arm 172 (and the polishing pad 170 mounted thereon) vertically (Z direction) as well as laterally (X and/or Y direction) relative to the substrate 102 and/or the chuck 167. The actuator 174 may also be utilized to move the support arm 172 (and the polishing pad 170 mounted thereon) in a sweeping motion, an orbital motion, or a circular motion relative to the substrate 102 and/or the chuck 167.

The polishing pad 170 may comprise a single pad that is ring-shaped. The polishing pad 170 may include a radius that is sized to substantially match the radius of the substrate 102. For example, if the radius of the substrate 102 is 150 mm, then the ring-shaped polishing pad may include an inside radius of about 120 mm to about 150 mm, and an outside radius of about 121 mm to about 155 mm. In one embodiment, the radius of the polishing pad 170 is determined based on the radius of the substrate 102 where correction is desired (i.e., area(s) where polishing resolution is not optimal when polished on the processing station 100). In some embodiments, the polishing pad 170 may include a radius of about 145 mm at a centerline thereof. In some embodiments, the inside radius and the outside radius may be substantially equal.

In the embodiment shown in FIG. 1B, the polishing pad 170 may include discrete arc segments having a radius as described above. In other embodiments, the polishing pad 170 may include arc-shaped segments, such as a crescent shape and/or multiple discrete shapes of pad material disposed on the support arm 172. In some embodiments, the polishing pad 170 comprises a membrane polishing pad which includes a variable pressure volume 162. The variable pressure volume 162 may be a void bounded on at least one side by the polishing material of the polishing pad 170. The variable pressure volume 162 is in fluid communication with a fluid source 178. The fluid source 178 may include air or other gases that are provided to the variable pressure volume 162. The air or other gases may pressurize the variable pressure volume 162 in order to inflate the polishing pad 170. The inflation metric (i.e., applied pressure) of the polishing pad 170 may be chosen based on a desired flexural property or compliance of the polishing pad 170 against the substrate. In one embodiment, the variable pressure volume 162 may be pressurized to about 0.1 pounds per square inch (psi) to about 10 psi.

The polishing module 101 also includes a fluid applicator 176 to provide a polishing fluid to the surface of the substrate 102. The fluid applicator 176 may include nozzles (not shown) and be configured similar to the fluid applicator 155 described in FIG. 1A. The fluid applicator 176 is adapted to rotate about axis F and may provide the same polishing fluids as the fluid applicator 155. The base 165 may be utilized as a basin to collect polishing fluid from the fluid applicator 176.

Figure 2B:
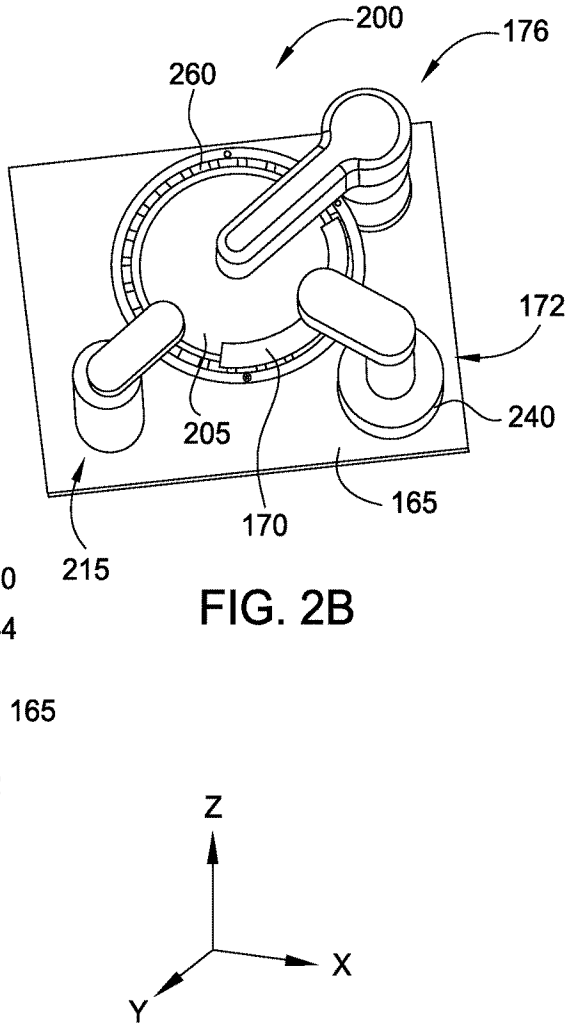
FIG. 2B is an isometric top view of the polishing module shown in FIG. 2A.
Figure 2A:
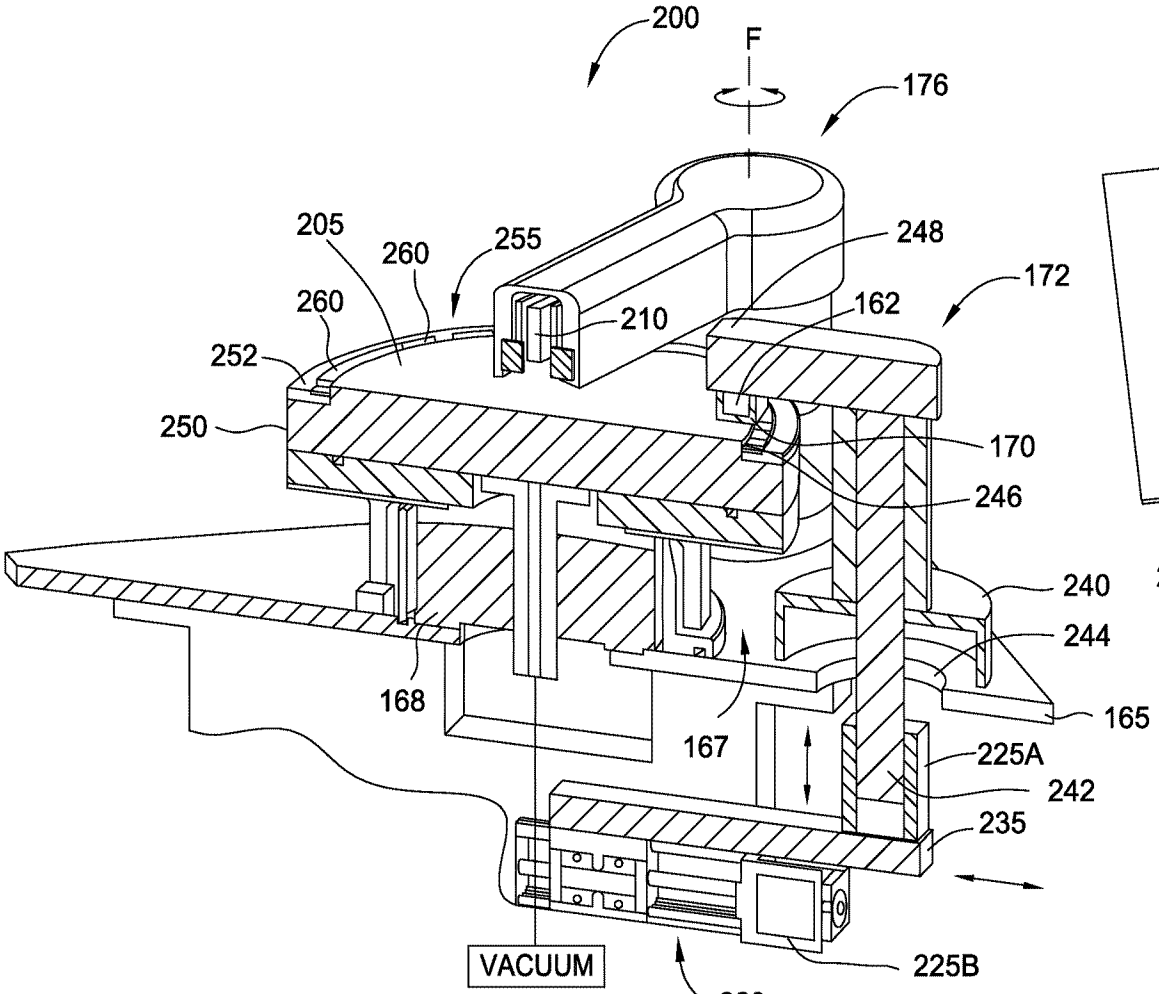
FIG. 2A is a side cross-sectional view of another embodiment of a polishing module.

FIG. 2A is a side cross-sectional view of another embodiment of a polishing module 200 that may be used alone or in conjunction with the processing station 100 of FIG. 1A. FIG. 2B is an isometric top view of the polishing module 200 shown in FIG. 2A. The polishing module 200 includes the chuck 167 which in this embodiment is coupled to a vacuum source. The chuck 167 includes a substrate receiving surface 205 that includes a plurality of openings (not shown) that are in communication with the vacuum source such that a substrate (shown in FIG. 1B) disposed on the substrate receiving surface 205 may be secured thereon. The chuck 167 also includes the drive device 168 that rotates the chuck 167. The fluid applicator 176 is also shown, which includes a nozzle 210 for delivering polishing fluids to the chuck 167. A metrology device 215 (shown in FIG. 2B) may also be coupled to the base 165. The metrology device 215 may be utilized to provide an in-situ metric of polishing progress by measuring the remaining thickness of a metal or dielectric film being polished on the substrate (not shown). The metrology device 215 may be an eddy current sensor, an optical sensor, or other sensing device that may be used to determine metal or dielectric film thickness. Other methods for ex-situ metrology feedback include pre-determining parameters such as location of thick/thin areas of deposition on the wafer, the motion recipe for the chuck 167 and/or the polishing pads 170, polishing time, as well as the downforce to be used. Ex-situ feedback can also be used to determine the final profile of the polished film. In situ metrology can be used to optimize polishing by monitoring progress of the parameters determined by the ex-situ metrology.

The support arm 172 is movably mounted on the base 165 by an actuator assembly 220. The actuator assembly 220 includes a first actuator 225A and a second actuator 225B. The first actuator 225A may be used to move the support arm 172 vertically (Z direction) and the second actuator 225B may be used to move the support arm 172 laterally (X direction, Y direction, or combinations thereof). The first actuator 225A may also be used to provide a controllable downforce that urges the polishing pad 170 towards the substrate (not shown). While only one support arm 172 having a polishing pad 170 thereon are shown in FIGS. 2A and 2B, the polishing module 200 is not limited to a single support arm 172. The polishing module 200 may include any number of support arms 172 as allowed by the circumference of the chuck 167 and sufficient space allowance for the fluid applicator 176 and the metrology device 215, as well as space for sweeping movement of the support arm 172 (and polishing pad 170 mounted thereon).

The actuator assembly 220 may comprise a linear movement mechanism 227, which may be a slide mechanism or ball screw coupled to the second actuator 225B. Likewise, each of the first actuators 225A may comprise a linear slide mechanism, a ball screw, or a cylinder slide mechanism that moves the support arm 172 vertically. The actuator assembly 220 also includes a support arm 235 coupled between the first actuator 225A and the linear movement mechanism 227. The support arm 235 may be actuated by the second actuator 225B. Thus, lateral movement of the support arm 172 (and polishing pad 170 mounted thereon) may include sweeping radially on the substrate (not shown) in a synchronized manner. A dynamic seal 240 may be disposed about a support shaft 242 that may be part of the first actuator 225A. The dynamic seal 240 may be a labyrinth seal that is coupled between the support shaft 242 and the base 165.

The support shaft 242 is disposed in an opening 244 formed in the base 165. The opening 244 may be a slot that allows lateral movement of the support arm 172 based on the movement provided by the actuator assembly 220. The opening 244 is sized to allow sufficient lateral movement of the support shaft 242 such that the support arm 172 (and polishing pad 170 mounted thereon) may move from a perimeter 246 of the substrate receiving surface 205 toward the center thereof (when the fluid applicator 176 is rotated to a position clear of the substrate receiving surface 205). In one embodiment, the substrate receiving surface 205 has a diameter that is substantially the same as the diameter of a substrate that would be mounted thereon during processing. For example, if the radius of the substrate receiving surface 205 is 150 mm, the support arm 172, particularly the polishing pad 170 mounted thereon, may move radially from about 150 mm (e.g., the perimeter 246) toward the center, and back to the perimeter 246. Additionally, the opening 244 is sized to allow sufficient lateral movement of the support shaft 242 such that an end 248 of the support arm 172 may be moved past a perimeter 250 of the chuck 167. Thus, when the fluid applicator 176 is rotated about axis F, and the end 248 of the support arm 172 is moved outward to clear the perimeter 250, a substrate may be transferred onto or off of the substrate receiving surface 205. The substrate may be transferred by a robot arm or end effector to or from the processing station 100 shown in FIG. 1A before or after a global CMP process. In one embodiment, the substrate may be transferred to or from the processing station 100 using the carrier head 130 (shown in FIG. 1A).

The chuck 167 may additionally include a peripheral edge region 252 positioned radially outward from the substrate receiving surface 205. The peripheral edge region 252 may be at a plane that is offset from (i.e., recessed below) a plane of the substrate receiving surface 205. The peripheral edge region 252 may also include a conditioning ring 255 that is used to condition the polishing pad 170. The height of the conditioning ring 255 may also be at a plane that is offset from (i.e., recessed below) a plane of the substrate receiving surface 205. The conditioning ring 255 may be one or more discrete abrasive elements 260 that comprise rectangular and/or arced members made of, or including, abrasive particles or materials. In one embodiment, the conditioning ring 255 includes a plurality of discrete abrasive elements 260, each of which are shaped as an arc segment. Each of the discrete abrasive elements 260 may comprise diamond particles that are used to condition the polishing pad 170 in between substrate polishing processes. For example, before or after a substrate is placed on the substrate receiving surface 205 of the chuck 167, the polishing pad 170 on the support arm 172 may be moved adjacent the conditioning ring 255 and below a plane of the substrate receiving surface 205. The polishing pad 170 may then be actuated or urged toward the conditioning ring 255 to cause the polishing pad 170 to contact the discrete abrasive elements 260. The chuck 167 may be rotated during this contact to condition the polishing pad 170. In one embodiment, the time period for conditioning of the polishing pad 170 is less than about 2 seconds, which may increase throughput of the polishing module 200. In one embodiment, conditioning of the polishing pad 170 may be performed during transfer of a substrate to or from the substrate receiving surface 205 of the chuck 167.

Figure 3:
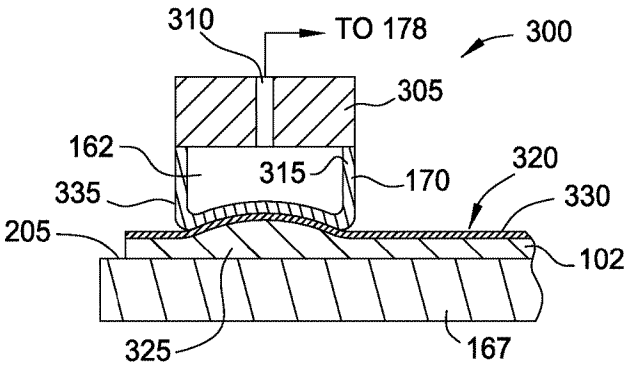
FIG. 3 is a side cross-sectional view of one embodiment of a polishing head.

FIG. 3 is a side cross-sectional view of one embodiment of a polishing head 300 according to embodiments disclosed herein. The polishing head 300 may be utilized in the polishing module 101 shown in FIG. 1B or the polishing module 200 shown in FIGS. 2A and 2B. For example, the polishing head 300 may be coupled to a support arm 172 of the polishing module 101 shown in FIG. 1B or the polishing module 200 shown in FIGS. 2A and 2B.

The polishing head 300 includes a polishing pad 170 as described herein that is mounted to a housing 305. The housing 305 includes a conduit 310 formed therein for delivery of fluids from the fluid source 178, such as air or other gases, to the variable pressure volume 162. In this embodiment, the variable pressure volume 162 is contained between an inner surface 315 of the polishing pad 170 and an interior surface of the housing 305. The variable pressure volume 162 may be pressurized to inflate the polishing pad 170 such that the processing surface of the polishing pad 170 (i.e., the region of the polishing pad 170 that contacts a feature side 320 of the substrate 102) conforms to the feature side 320 of the substrate 102.

The conformal properties of the polishing pad 170 may have particular importance when the topography of the substrate 102 is not uniform or non-planar. In one example, the substrate 102 may include a high spot 325 as shown in FIG. 3. Although not shown in FIG. 3, the substrate 102 may also include other high spots, as well as low spots, or combinations thereof.

The non-planarity in the substrate 102, such as the high spot 325, may be caused by unevenness in the substrate 102 itself, such as by warping induced by prior processing, among other factors, such as non-uniform removal of material in a prior CMP process. Alternatively or additionally, the non-planarity in the substrate 102 may be caused by unevenness in the substrate receiving surface 205 of the chuck 167. In some instances, a to-be-removed film 330 on the substrate 102 may have a substantially uniform thickness regardless of the non-planarity of the substrate 102. The to-be-removed film 330 may be a metal, such as copper, tungsten or other metals, a dielectric, or other film.

In conventional CMP systems, the polishing pad may not conform to the topography of the feature side 320 of the substrate 102, and non-uniform material removal may occur. The non-uniform material removal may reduce yield, and is minimized by using the polishing head 300, which provides a conformal polishing pad 170. The conformal polishing pad 170 flexes to smooth pressure applied to local areas of the substrate 102, which facilitates uniform removal of the to-be-removed film 330. The conformal polishing pad 170 also distributes forces equally about the high spot 325 and regions adjacent to the high spot 325.

In one embodiment, the material of the polishing pad 170 may be closed-cell foam in order to contain the fluid in the variable pressure volume 162. In other embodiments, the variable pressure volume 162 may be formed by a bladder disposed between the housing 305 and the inner surface 315 of the polishing pad 170. In other embodiments, a liner may be disposed on the inner surface 315 of the polishing pad 170 to seal the variable pressure volume 162. In some embodiments, sidewalls 335 of the polishing pad 170 may be reinforced to enhance structural integrity of the sidewalls 335 without minimizing flexibility of the processing surface of the polishing pad 170.

Figure 4:
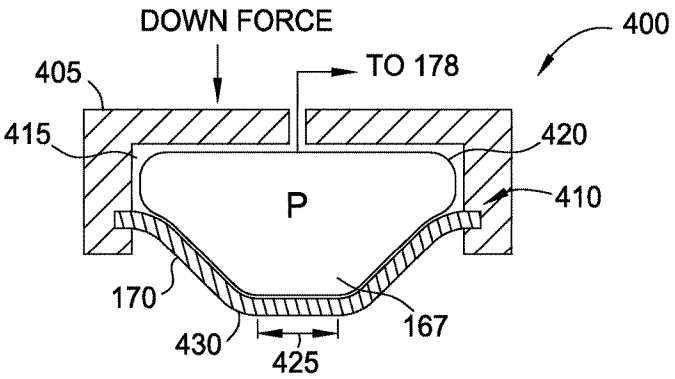
FIG. 4 is a side cross-sectional view of another embodiment of a polishing head.

FIG. 4 is a side cross-sectional view of another embodiment of a polishing head 400 according to embodiments disclosed herein. The polishing head 400 may be utilized in the polishing module 101 shown in FIG. 1B or the polishing module 200 shown in FIGS. 2A and 2B. For example, the polishing head 400 may be coupled to a support arm 172 of the polishing module 101 shown in FIG. 1B or the polishing module 200 shown in FIGS. 2A and 2B. The polishing head 400 is substantially similar to the polishing head 300 shown in FIG. 3 with the following exceptions.

The polishing head 400 includes a polishing pad 170 as described herein that is mounted to a housing 405. The polishing pad 170 may be coupled to the housing 405 by a clamp device 410 in one embodiment. Internal surfaces of the housing 405 and the polishing pad 170 may define a void 415 where a bladder 420 may be positioned. The bladder 420 may be coupled to the fluid source 178 and operate similarly to the polishing head 300 of FIG. 3.

In one embodiment of the polishing heads 300 and 400 as described herein and illustrated in FIG. 4, a contact area 425 is shown on a processing surface 430 of the polishing pad 170. The contact area 425 may be the area of the processing surface 430 contacts a substrate (not shown) or a film to be removed that is deposited on the substrate (shown in FIG. 3). The contact area 425 may be concave as shown in FIG. 3 during polishing, convex during polishing, or a combination thereof, dependent on the topography of the substrate. In one aspect, the contact area 425 is a function of pressure P pressure in the bladder 420 in FIG. 4 or the variable pressure volume 162 in FIG. 3) and down force applied to the polishing head 400. The concept is more specified in Equation 1, below.

$$\text{Contact area} \times \text{Pressure} = \text{Down force} + \text{Weight (of the polishing head)} \qquad \text{Equation 1}$$

In the equation above, weight is a constant and includes the weight of the polishing head 300 or 400, including the polishing pad 170, the housing 305 or 405, as well as any portions of a support arm 170 (shown in FIGS. 1B and 2A, 2B). In one embodiment, the contact area 425 may be adjusted by varying the down force and holding pressure P constant. In some embodiments, the contact area 425 may be about 1 mm to about 8 mm, or greater. In one embodiment, the contact area 425 may be controlled based on a process recipe.

Figure 5B:
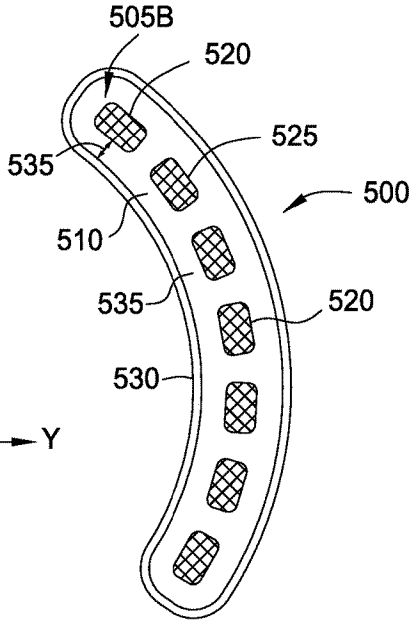
FIGS. 5A and 5B are top views showing various embodiments of a polishing pad.
Figure 5A:
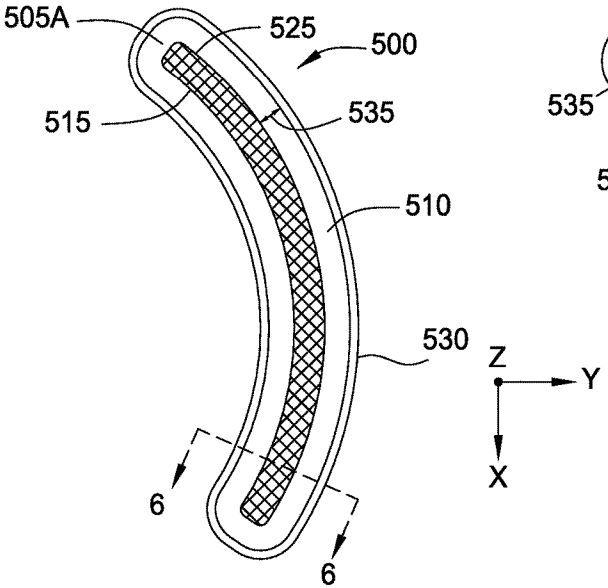

FIGS. 5A and 5B are top views showing various embodiments of a polishing pad 500. The polishing pad 500 may be coupled to the housing 405 shown in FIG. 4 and utilized in the polishing module 101 shown in FIG. 1B or the polishing module 200 shown in FIGS. 2A and 2B. The polishing pad 500 includes a contact region 505A and 505B disposed at or near a center of a flexible base 510. Each of the contact regions 505A and 505B may constitute the contact area 425 shown and described in FIG. 4, in some embodiments. The contact regions 505A and 505B may be raised from the flexible base 510.

In one embodiment, the contact region 505A comprises an elongate arc segment 515 while the contact region 505B comprises a plurality of discrete contact pads 520 oriented in an arc on the flexible base 510. In some embodiments, both of the arc segment 515 and the contact pads 520 include grooves 525 formed in an upper surface thereof. The grooves 525 may assist in transportation of polishing fluids when the polishing pad 500 is in use. The flexible base 510 includes a perimeter 530 that is utilized to couple with a polishing head, such as the polishing head 400 shown in FIG. 4. The perimeter 530 may be formed along the same arc as the arc segment 515 or the contact pads 520 such that a distance 535 between the perimeter 530 and the contact region 505A or 505B is substantially the same there around.

In some embodiments, the polishing pad 500 is circular. For example, the contact region 505A may have a diameter of about 10 mm to about 100 mm.

The flexible base 510 is configured as a thin membrane which provides a flexible coupling for the contact regions 505A and 505B. The flexible base 510 is sufficiently thick and wide to promote flexibility in the Z direction (i.e., the inflation or deflation direction) to conform to non-planarity in a substrate. The thickness and width of the flexible base 510 is also configured to provide structural stability for the contact regions 505A and 505B such that the flexible base 510 stably maintains the position of the contact regions 505A and 505B in response to horizontal loading in the X and/or Y direction that may be experienced during polishing.

Figure 6:
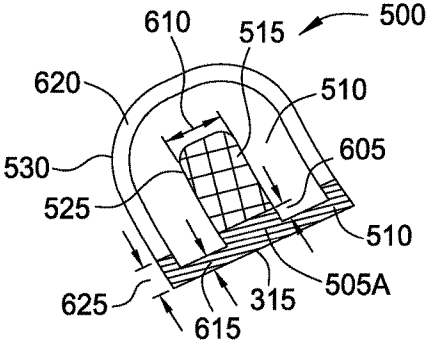
FIG. 6 is an isometric cross-sectional view of a portion of the polishing pad along lines 6-6 of FIG. 5A.

FIG. 6 is an isometric cross-sectional view of a portion of the polishing pad 500 along lines 6-6 in FIG. 5A. A portion of the contact region 505A is shown disposed on the flexible base 510. In the embodiment shown, the contact region 505A is integral to the flexible base 510. However, in other embodiments, the contact region 505A may be a separate element or elements (in the case of the contact pads 520 shown in FIG. 5B). When the contact region 505A is separate, the contact region 505A and 505B may be easily replaced. Since the contact region 505A is the only portion of the polishing pad 500 that contacts a substrate and may wear, replacement of the contact region 505A on the flexible base 510 decreases costs of the polishing pad 500. Additionally, a removable contact region 505A may allow use of different materials for the contact region 505A in order to enhance removal of materials from the substrate. An exemplary attachment feature may include fasteners (not shown) extending into the contact region 505A from an inner surface 315 of the polishing pad 500. Adhesives, such as a pressure sensitive adhesive, may also be used as an attachment feature.

In some embodiments, the contact region 505A is raised from the flexible base 510 by a distance 605. The distance 605 may be about 0.5 mm to about 4 mm, such as about 2 mm. A width 610 of the contact region 505A may be about 1 mm to about 20 mm, or greater, such as about 2 mm to about 6 mm. A thickness 615 of the flexible base 510 may be about 0.1 mm to about 3 mm, depending on such factors as desired flexibility and/or width of the flexible base 510, among others. In some embodiments, the perimeter 530 of the flexible base 510 includes a raised lip 620 which may be used to facilitate clamping of the polishing pad 500 to a housing, such as the housing 405 shown in FIG. 4. The perimeter 530 including the lip 620 may include a thickness of about 0.1 mm to about 6 mm, such as about 0.1 mm. In some embodiments, a thickness of the perimeter 530 including the lip 620 is about twice that of the thickness 615 of the flexible base 510.

While the foregoing is directed to embodiments of the present disclosure, other and further embodiments of the disclosure may be devised without departing from the basic scope thereof, and the scope thereof is determined by the claims that follow.

The invention claimed is:

1. A polishing device, comprising:

a support arm extending in a first direction over a circular chuck from a perimeter of the chuck;

a movement mechanism coupled to the support arm;

a housing fixed to the support arm in a second direction that is orthogonal to the first direction;

a flexible base coupled to the housing; and a contact region disposed on a first side of the flexible base and protruding from the flexible base, the contact region being shaped in an arc having a radius that has a center that is substantially positioned along an axis of rotation of the circular chuck when the support arm is disposed over the circular chuck, wherein the flexible base expands and contracts based on pressure contained within the housing and a second side of the flexible base to form a contact area on the first side that is less than a surface area of the flexible base.

2. The device of claim 1, wherein the contact region is positioned on the base along an arc segment.

3. The device of claim 1, wherein the contact region comprises a plurality of contact pads.

4. The device of claim 1, wherein the flexible base comprises a raised lip at a perimeter thereof.

5. The device of claim 1, wherein the contact area is adjustable.

6. The device of claim 5, wherein the adjustment of the contact area is based on a process recipe.

7. The device of claim 1, wherein the contact region is arc-shaped.

8. The device of claim 1, wherein the contact region is circular.

9. A polishing module, comprising:

a rotatable chuck having a substrate receiving surface and a perimeter;

a support arm extending in a first direction over the perimeter of the chuck that is movable relative to the chuck;

a housing fixed to the support arm in a second direction that is orthogonal to the first direction; and a polishing pad disposed on the housing, the polishing pad comprising a contact region positioned about a center of a flexible base and protruding from the flexible base, the contact region disposed in an arc that is at least concentric with the perimeter of the chuck, wherein the polishing pad is inflatable by pressure application to a backside of the flexible base.

10. The module of claim 9, wherein the contact region is detachably coupled to the flexible base.

11. The module of claim 9, wherein the contact region is arc-shaped.

12. The module of claim 9, wherein the contact region is circular.

13. A method of polishing a substrate, comprising:

providing a support arm positioned about a perimeter of a chuck that is linearly movable relative to the chuck;

urging a polishing pad disposed on the support arm positioned in a cantilevered orientation over the chuck against a surface of a substrate positioned on the chuck, the polishing pad being disposed on a flexible base and being shaped in an arc that is concentric with an edge of the substrate; and adjusting a contact area of the polishing pad by adjusting a pressure to a backside of the flexible base, wherein the contact area is less than a surface area of the flexible base and protrudes from the flexible base.

14. The method of claim 13, wherein the adjusting of the contact area is based on a process recipe.

15. The method of claim 14, wherein the contact area conforms to the surface of the substrate.

16. The method of claim 13, wherein the contact area is arc-shaped.

17. The method of claim 16, wherein the contact area conforms to the surface of the substrate.

18. The method of claim 13, wherein the contact area is circular.

19. The method of claim 18, wherein the contact area conforms to the surface of the substrate.

* * * * *